United States Patent [19]

Collins et al.

[11] 4,188,696

[45] Feb. 19, 1980

[54] ABRADING TOOL

[76] Inventors: Robert C. Collins, 746 NE. 67th St., Miami, Fla. 33138; Wallace E. Weber, 6832 SW. 81 St., Miami, Fla. 33143

[21] Appl. No.: 889,653

[22] Filed: Mar. 24, 1978

[51] Int. Cl.[2] ..... B21C 43/00

[52] U.S. Cl. ..... 29/81 J; 125/5

[58] Field of Search ..... 51/181 R, 209 R; 29/81 R, 81 G, 81 J, 81 L; 125/3, 4, 5

[56] References Cited

U.S. PATENT DOCUMENTS

| | | | |
|---|---|---|---|
| 3,309,729 | 3/1967 | Dresser | 125/3 X |
| 3,351,046 | 11/1967 | Collins | 125/5 |
| 3,365,772 | 1/1968 | Collins | 125/5 X |
| 3,451,721 | 6/1969 | Highberg et al. | 125/5 X |
| 3,664,068 | 5/1972 | Metzger et al. | 51/209 R |
| 3,942,208 | 3/1976 | Southard | 125/5 X |

*Primary Examiner*—Harold D. Whitehead
*Assistant Examiner*—Robert P. Olszewski
*Attorney, Agent, or Firm*—Oltman and Flynn

[57] ABSTRACT

In an abrading tool having a cup-shaped outer housing with a shank for attachment to a power-driven chuck and rotatable abrading discs on radial axles inside this housing, a plurality of knocker bars are attached to the outside of this housing. As the rotating housing is moved across the surface to be abraded, these knocker bars appear in succession at its leading side to bite into the material there and overcome the tendency of the abrading discs to ride over this material.

2 Claims, 5 Drawing Figures

ABRADING TOOL

BACKGROUND OF THE INVENTION

The present invention embodies and is an improvement upon the abrading tool disclosed in U.S. Pat. No. 3,365,772 to Robert C. Collins. While the tool of that patent is very well adapted for its intended purposes, certain difficulties have been encountered in using it to remove thick barnacles or other marine growths from exposed surfaces of seawalls, piers, pilings and similar structures. Barnacle growth often exceeds three inches in thickness, and sometimes the rotatably mounted abrading discs in the tool shown in the aforementioned patent tend to ride across the barnacle surfaces instead of biting into and removing them from the underlying structure. The same difficulty can be encountered when using the tool to remove solidified concrete spills from road surfaces or undesired concrete droppings in building structures.

SUMMARY OF THE INVENTION

The present invention is a modification of the previously mentioned type of abrading tool which overcomes this difficulty.

In accordance with the presently-preferred embodiment of the invention, a plurality of knocker bars are attached to the outside of the cylindrical side wall of the rotatable housing of the abrading tool. As this housing is rotated by the power driven chuck and is advanced across the material to be abraded, the knocker bars appear in succession at the leading edge of the tool. The cutter bars bite into the material that is to be removed and then the usual abrading discs are brought into engagement with this material to complete its removal. It has been found that the addition of these knocker bars improves the action of the tool on relatively thick materials, particularly barnacles.

Accordingly, it is a principal object of this invention to provide an abrading tool having a novel arrangement for improving its effectiveness on thick deposits of material to be removed from an underlying structure.

Another object of this invention is to provide an abrading tool having a novel knocker bar arrangement for preventing it from riding over such deposits without biting into and removing them effectively.

Further objects and advantages of this invention will be apparent from the following detailed description of a presently-preferred embodiment thereof, which is shown in the accompanying drawings in which.

Figure 1:
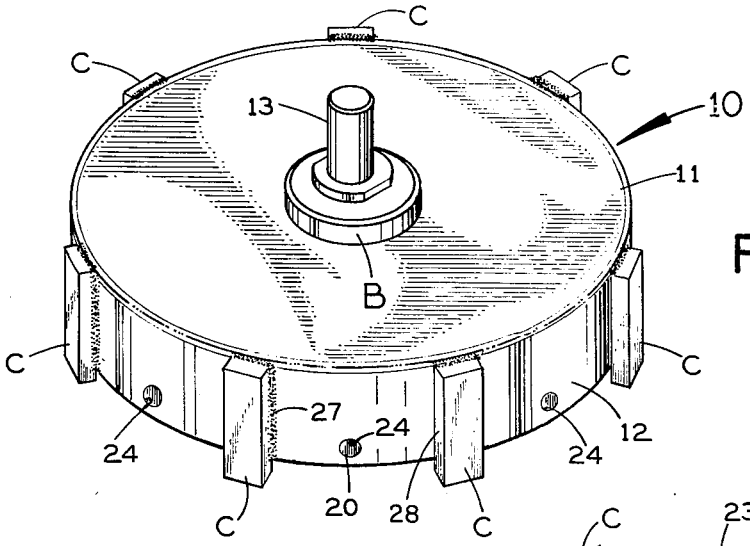
FIG. 1 is a perspective view of the present abrading tool.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Referring to the drawing, the present abrading tool has a generally cup-shaped outer housing 10 with a flat, circular top wall 11 and a cylindrical side wall 12 extending down from the top wall at the latter's periphery. This housing carries a shank 13 for attachment to a power-driven chuck (not shown), such as the chuck of an electric, hydraulic or pneumatic drill, sander, grinder or polisher. The shank 13 may be removed and the standard externally threaded drive shaft of the power tool may be directly threaded into the housing 10 at the center of the top wall 11. Alternatively, the shank 13 may be inserted into a drive adapter which is externally threaded for insertion in the power driven chuck on a tool where the chuck is not removable. The shank 13 is clamped to the housing 10 at the center of the top wall 11, as explained hereinafter. The axis of the cylindrical side wall 12 of the housing coincides with the central axis of the shank 13.

A similarly shaped but smaller intermediate housing 14 (FIG. 3) and an even smaller inner housing 15 are mounted coaxially inside the outer housing 10. The intermediate housing 14 presents a flat, circular top wall 16, which engages the bottom face of the top wall 11 of the outer housing 10, and a depending cylindrical side wall 17, which extends parallel to the side wall 12 of the outer housing and is spaced radially inward from the latter. The inner housing 15 has a flat, circular top wall 18, which engages the bottom face of the top wall 16 of the intermediate housing 14, and a depending cylindrical side wall 19, which extends parallel to the side wall 17 of the intermediate housing and is spaced radially inward at 29 from the latter.

Figure 3:
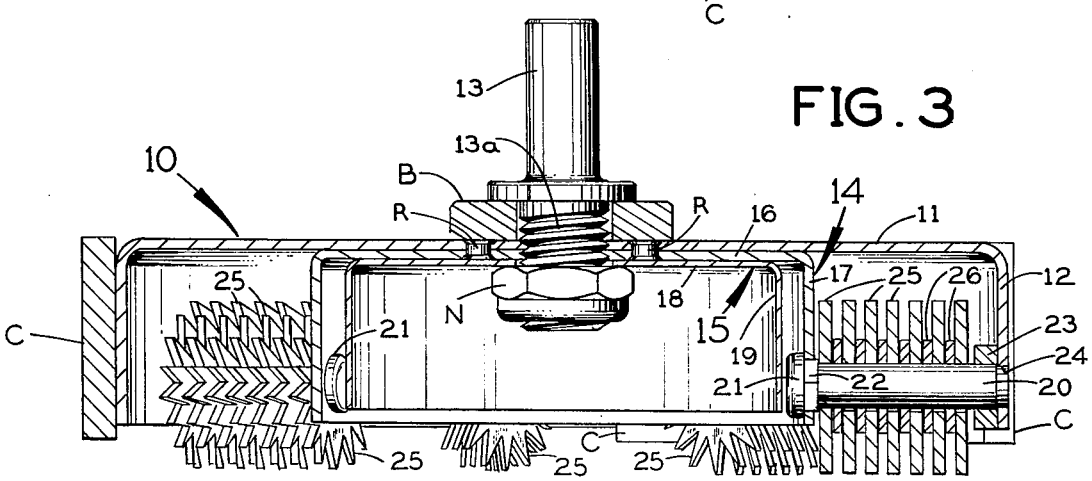
FIG. 3 is a cross-section taken centrally across the tool along the line 3—3 in FIG. 2.

The abutting top walls of the outer housing 10, the intermediate housing 14 and the inner housing 15 are formed with respective central openings which register with each other. The shank 13 has a screw-threaded lower end segment 13*a* which extends down through these openings, as best seen in FIG. 3. This threaded segment is screw-threadedly received in a bushing B which is spot welded to the top of the outer housing 10 around the central opening in the latter. Rivets R extend through this bushing and down through the outer housing 10 and the intermediate housing 14 to attach these parts permanently.

The inner housing 15 is clamped to the intermediate housing by a nut N which is threaded onto the screw-threaded segment 13*a* of the shank 13 below the top wall of the inner housing.

The outer and intermediate housings 10 and 14 support a plurality of circumferentially spaced axles 20, here shown as seven in number, extending from the side wall 12 of the outer housing 10 radially inward through the side wall 17 of the intermediate housing 14. The inner end of each axle carries an enlarged head 21 (FIG. 3) engaging the inside of the side wall 17 of the intermediate housing. Just outward from this head each axle 20 presents a squared segment 22 which is snugly received in a square opening in the side wall 17 of the intermediate housing to prevent rotation of the axle 20 with respect to the housings 10 and 14. Near its outer end each axle is slidably received in a cylindrical spacer 23 affixed to the inside of the side wall 12 of the outer housing. The outer end of each axle is slidably received in a cylindrical opening 24 in the side wall 12 of the outer housing.

Each non-rotatably mounted axle 20 rotatably supports a plurality of toothed abrading discs 25, which are separated along the axle by flat metal washers 26. As shown in FIG. 3, these abrading discs project beyond the open end of the housings (at the end away from the shank 13) for abrading the material that is to be removed from the surface to be cleaned.

In the use of the abrading tool, as thus far described, to clean thick barnacles or other marine growth off pilings, piers, seawalls and the like, difficulty has been encountered due to the tendency of the abrading discs 25 to ride across the outside of such growths instead of biting into them. The same problem can occur with concrete droppings on roads or in building structures.

In accordance with the present invention, a plurality of knockers are provided on the outside of the side wall 12 of the outer housing 10 of the abrading tool. As this housing is rotated by the power-driven chuck and is advanced by the user over the material to be abraded, these knocker bars appear in succession at the leading side of the tool for biting engagement with the material that is to be removed. In effect, these knockers cut a pathway through that material before it is engaged by the abrading discs 25. The provision of these knockers has been found to be extremely effective in preventing the former tendency of the abrading discs to ride over the surface of thick barnacles or other marine growths without removing them.

In the presently preferred embodiment, these knockers comprise as many knocker bars C as the number of axles 20 for the abrading discs. Each knocker bar is located on the periphery of the outer housing 10 between two of the axles 20, as shown in FIG. 1. Preferably, as shown, each knocker bar C is rectangular in cross-section and extends the full height of the side wall 12 of the outer housing 10. The knocker bars may be of ordinary steel but, if desired, they may be of steel which has been specially hardened for a longer life. Each knocker bar is rigidly attached to the side wall of the outer housing by a weld 27 extending along one edge and across the top only. This welded side edge will be the trailing edge of the knocker bar when the tool is rotated by the power-driven chuck in the latter's "forward" direction (clockwise in FIG. 1). At the opposite side from the weld 27, each knocker bar presents a flat, rectangular face 28 which extends out from the side wall 12 of the outer housing virtually radially with respect to the rotational axis of the tool.

In the use of this tool, as the tool is advanced across the material to be removed from the underlying structure, the rotation of the outer housing 10 moves the leading face 28 on each of the knocker bars C in succession across the leading edge of the tool to bite into the material and cut a path through it before the abrading discs 25 are brought into engagement with this material.

When any knocker bar becomes worn down, a new cutter bar may be welded in place next to it without the necessity of removing the worn knocker bar.

Figure 2:
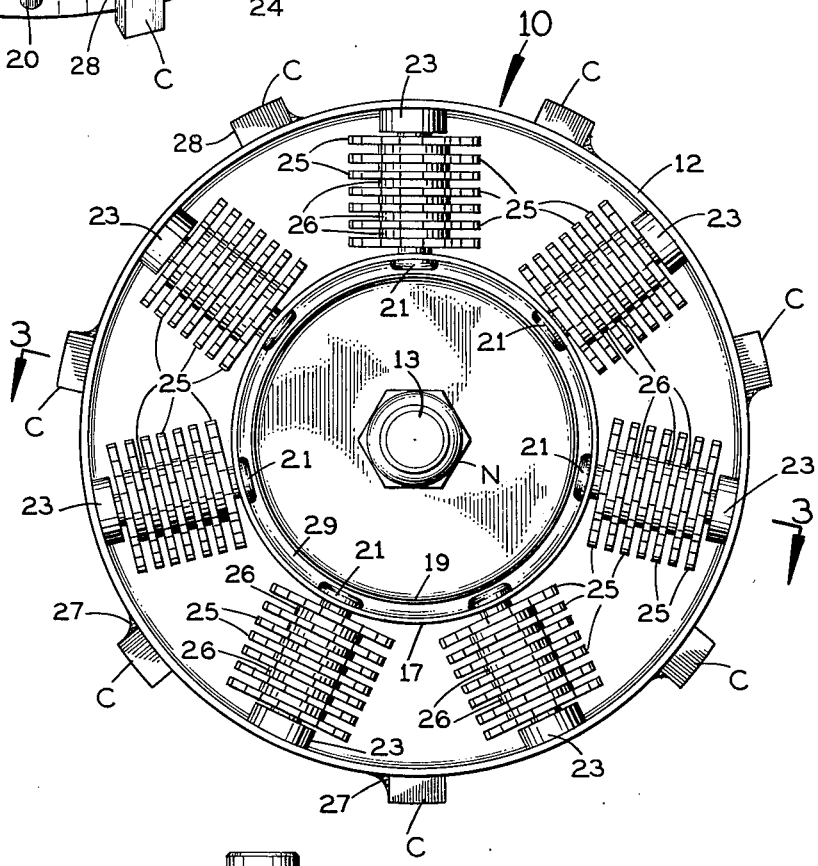
FIG. 2 is a bottom plan view of this tool.
Figure 4:
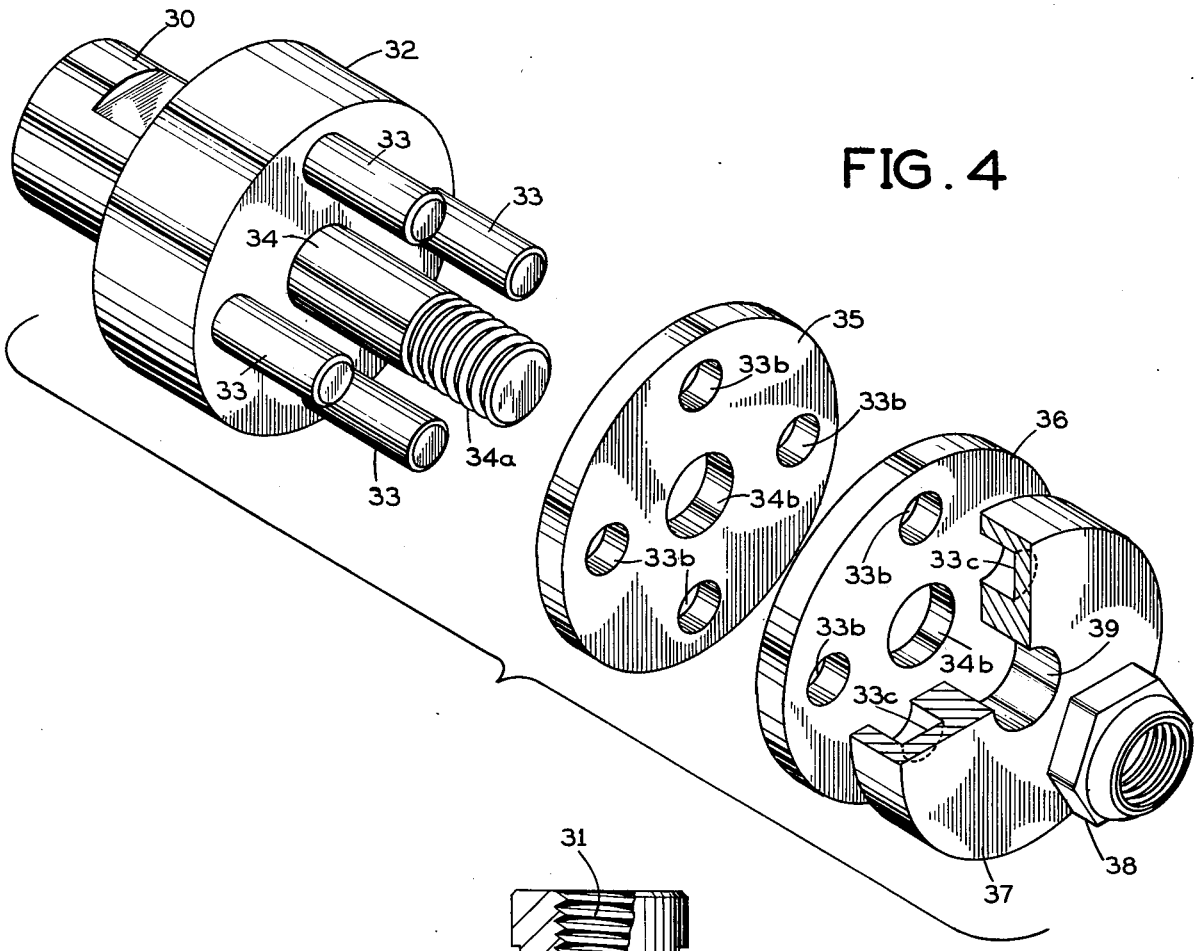
FIG. 4 is an exploded perspective view of a cushioned adapter assembly for use in the present tool.
Figure 5:
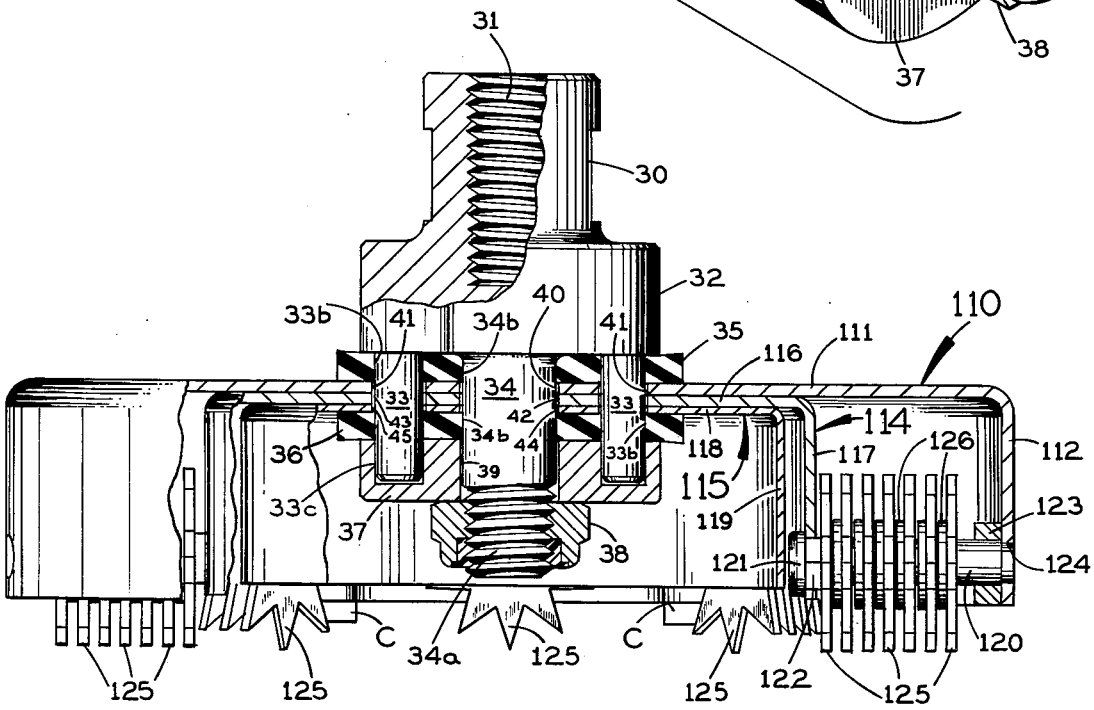
FIG. 5 is a view similar to FIG. 3 and showing the tool with this cushioned adapter.

FIG. 5 shows the present tool provided with a cushioned adapter assembly as shown in FIG. 4. In FIG. 5 elements of the tool which correspond to those in FIGS. 1–3 are given the same reference numerals plus 100, and the detailed description of these elements will not be repeated.

The cushioned adapter includes a one-piece body having an upper shank 30 with an internally screw-threaded, axial recess 31 that is open at its upper end. The shank 30 is integrally connected to a transversely enlarged, cylindrical segment 32 from which four coupling pins 33 project downward. These pins are equally spaced apart from each other circumferentially at equal radial distances from a lower shank 34, which is coaxial with the upper shank 30 and is connected integrally to the enlarged cylindrical segment 32. The lower shank 34 projects axially beyond the pins 33 and terminates in a screw-threaded bottom end segment **34*a***.

The adapter also includes two pads 35 and 36 of rubber or rubber-like material, a metal bottom plate 37 and a nut 38.

Each pad 35 or 36 preferably is about ¼ inch thick and is formed with four openings **33*b* for snugly passing the respective pins 33 and a central opening 34*b* for snugly passing the lower shank 34** on the adapter body.

The bottom plate 37 has a central opening 39 through which the lower shank 34 and its threaded bottom end segment **34*a* extend, as shown in FIG. 5. The bottom plate 37 also has four cylindrical recesses 33*c* which are open at the top for snugly receiving the lower ends of the pins 33**.

The top wall 111 of the cup-shaped outer housing 110 of the present tool is formed with a central opening 40 for passing the lower shank 34 of the FIG. 4 adapter body with a slight clearance, as shown in FIG. 5. Also, the top wall 111 of the outer housing 110 has four openings 41 for similarly passing the respective pins 33 on the adapter body.

The top wall 116 of the intermediate housing 114 is formed with a similar central opening 42, which registers with the opening 40 in the outer housing 110, and four openings 43, which register individually with the openings 41 in the outer housing.

The top wall 118 of the inner housing 115 similarly has a central opening 44, which registers with the openings 40 and 42, and four openings 45, which register individually with the respective openings 41 and 43.

When fully assembled, the upper pad 35 is engaged between the cylindrical segment 32 of the adapter body and the top wall 111 of the outer housing 110, and the lower pad 36 is engaged between the bottom face of the top wall 118 of the lower housing 117 and the top face of the bottom plate 37. The nut 38 is threaded onto the screw-threaded bottom end segment **34*a* of the lower shank 34 on the adapter body, as shown in FIG. 5**, to clamp the parts together.

With this cushioned adapter, the tool is properly centered with respect to the drive chuck while at the same time the adapter permits a certain amount of cushioned flexing of the tool laterally and axially so that a limited floating action of the tool is provided, which enhances its performance in producing a smooth surface.

We claim:

1. In an underwater abrading tool for attachment to a power tool, said abrading tool having:

a cylindrical outer cup having a spindle aperture through its end coaxial with the principal axis of said outer cup;

a second cylindrical cup nested in said outer cup having a peripheral wall in uniform spaced relation from the peripheral wall of said outer cup and having a spindle aperture coaxially positioned in the end thereof nested in said outer cup;

a spindle means positioned through each said spindle aperture and coaxial with said principal axis including a detachable fastening means at one end portion therof for securing each said end of each said cups in adjacent relation on said spindle means with the opposite end of said spindle means forming a shank for engagement in a power driven chuck of the power tool;

a plurality of axles spaced angularly from each other about said principal axis and extending radially between said peripheral walls of said cups and supported by said cups;

and a plurality of abrading disc means journaled for rotation on each of said axles in the space between said peripheral wall of said outer cup and said peripheral wall of said second cup whereby said abrading disc means will rotate and abrade barnacles when in contact therwith when said shank is secured in chuck means and rotated thereby, said abrading discs having a tendency to ride over thick deposits of barnacles in an underwater location;

the improvement which comprises:

a plurality of knocker means on the outside of said outer peripheral wall of said outer cup for engagement with thick barnacles in an underwater location in advance of the engagement of said abrading discs therewith as said abrading tool is rotated by the power tool and is moved across said barnacles;

each of said knockers being located between a pair of said axles to assure that each knocker engages thick barnacles ahead of the following abrading discs for knocking off thick material and leaving an underlying surface to be abraded by said abrading discs;

said abrading discs projecting beyond an axial extremity of each of said knockers through the open end of said cups for abrading thinner barnacles without interference from said knockers;

said spindle means comprising an adapter body for connecting said abrading tool to the power tool;

means for releasably clamping said adapter body to said cups of the abrading tool;

and flexible and resilient cushion means engaged between said fastening means of the abrading tool and said adapter body for permitting limited flexing of the abrading tool with respect to the adapter body.

2. The combination of claim 1, wherein:

said adapter body has an axial shank projecting downward therefrom and having a screw-threaded lower end and said adapter body also has a plurality of pins projecting downward parallel to said shank;

said clamping means comprises a plate with a central opening which passes said shank on the adapter body and recesses which receive said pins, said fastening means threadedly engaging the threaded lower end of the shank below said plate;

said cushion means comprises an upper pad of rubber-like material engaged between said adapter body and said outer cup of the abrading tool, and a lower pad of rubber-like material engaged between said plate and said second cup of the abrading tool.

* * * * *